United States Patent [19]

Machado

[11] Patent Number: 4,825,891

[45] Date of Patent: May 2, 1989

[54] PORTABLE HUT

[76] Inventor: Jack Machado, 26 Heather Ave., Kitchener, Ontario, Canada, N2B-1M1

[21] Appl. No.: 135,982

[22] Filed: Dec. 21, 1987

[51] Int. Cl.[4] ..... E04H 15/34

[52] U.S. Cl. ..... 135/101; 135/117; 135/116; 135/118

[58] Field of Search ..... 135/101, 116, 118, 117, 135/120

[56] References Cited

U.S. PATENT DOCUMENTS

| | | | |
|---|---|---|---|
| 1,925,815 | 9/1933 | Nicolson | 135/101 X |
| 3,441,037 | 4/1969 | Transeau | 135/116 X |
| 4,197,681 | 4/1980 | Holcombe | 135/101 X |
| 4,263,925 | 4/1981 | Arganbright | 135/118 X |
| 4,404,980 | 9/1983 | Wade | 135/118 X |
| 4,590,956 | 5/1986 | Griesenbeck | 135/116 |
| 4,607,655 | 8/1986 | Wagner | 135/116 X |

*Primary Examiner*—J. Karl Bell

*Attorney, Agent, or Firm*—Leon Gilden

[57] ABSTRACT

A portable shelter is set forth easily erected and disassembled for ready transport of same. Captured "U" shaped supports are secured within conduits formed by means of an elongate capture fabric secured to tent fabric structure to capture the supports therein. Linear supports are positioned within four corners of the tent fabric structure and are also captured in a similar capture fabric wherein the formed contents for securing the support elements therein are discontinuous medially of the tent height to enable visual manipulation and securement of the various supports together. Included in the portable structure is a removable floor formed with integral compartments for inflation thereof for selective use of the compartments as an air mattress. Additionally, luminescent portions are positioned overlying the entrance flaps to the structure for indication of orientation of the tent and positioning of the entranceway during periods of limited light.

1 Claim, 4 Drawing Sheets

PORTABLE HUT

BACKGROUND OF THE INVENTION

1. Field of the Invention

The present invention relates to portable structures, such as tents and the like, and more particularly pertains to a new and improved hut which may be compactly folded for transporting thereof or readily erected as need dictates.

2. Description of the Prior Art

The use of portable structures is well known in the prior art. As may be appreciated, these devices have been of relatively cumbersome organization generally adapted for specialized use. The need for a multi-purpose structure of tent-like organization permitting adaptability to a variety of needs has not heretofore been developed. For example, U.S. Pat. No. 1,862,425 to Pooch illustrates a portable lodge formed of a multi interlinked skeleton organization over which a fabric-like covering is manipulatable. The bulky and awkward organization plus the limited application renders the Pooch patent rather removed from the instant invention.

U.S. Pat. No. 3,092,126 to Smith sets forth a portable structure for use as of a portable carport in which a rather elaborate organization permits pivoting and extending of various linkages to enable a flexible structure to be secured thereover. The Smith patent suffers the same shortcomings as the previously noted Pooch patent.

U.S. Pat. No. 3,896,831 to Feldman sets forth a tent utilizing a specialized skeleton over which the fabric-like material may be provided to enable its use as a rapidly erected shelter and for applying a spreading force to the eave poles to tension the roof therebetween.

U.S. Pat. No. 4,057,284 to Blank sets forth a collapsible camper wherein interfolded sections enables the collapse of the device into a relatively compact unit for ease of portability limited, however, to applications in combination to a relatively rigid structure unlike the benefits of the instant invention.

U.S. Pat. No. 4,198,996 to Keable sets forth a portable tent in which various bows and framework enables an elaborate structure to be secured about the included skeleton work. The relatively complex organization of the patent fails to overcome the deficiencies of the prior art as set forth.

As such, it may be appreciated that there is a continuing need for a new and improved portable hut which addresses both the problem of storage and portability as well as adaptability to a variety of needs and in this respect, the present invention substantially fulfills this need.

SUMMARY OF THE INVENTION

In view of the foregoing disadvantages inherent in the known types of portable structures now present in the prior art, the present invention provides an portable hut wherein captured framework elements are positioned for immediate attachment with one another to provide for immediate erection of the portable tent including optionally removable inflatable floor sections for use as necessary. As such, the general purpose of the present invention, which will be described subsequently in greater detail, is to provide a new and improved portable hut which has all the advantages of the prior art portable structures and none of the disadvantages.

To attain this, the present invention comprises a portable hut which may be compactly folded during periods of nonuse and rapidly erected when needed resultant from the captured structural elements comprising the framework of the hut. Selectively employable inflatable mattress floor portions of the tent are disengageable in the organization by means of a zippered interconnection therewith. Additionally, luminescent segments are positioned on the door portion of the tent to permit orientation of a user to the tent during periods of limited light.

My invention resides not in any one of these features per se, but rather in the particular combination of all of them herein disclosed and claimed and it is distinguished from the prior art in this particular combination of all of its structures for the functions specified.

There has thus been outlined rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable hut which has all the advantages of the prior art portable huts and none of the disadvantages.

It is another object of the present invention to provide a new and improved portable hut which may be easily and efficiently manufactured and marketed.

It is a further object of the present invention to provide a new and improved portable hut which is of a durable and reliable construction.

An even further object of the present invention is to provide a new and improved portable hut which is susceptible of a low cost of manufacture with regard to both materials and labor, and which accordingly is then susceptible of low prices of sale to the consuming public, thereby making such portable huts economically available to the buying public.

Still yet another object of the present invention is to provide a new and improved portable hut which provides in the apparatuses and methods of the prior art some of the advantages thereof, while simultaneously overcoming some of the disadvantages normally associated therewith.

Still another object of the present invention is to provide a new and improved portable hut which may be rapidly erected due to the pre-positioned captured structural elements comprising the framework of the hut.

Yet another object of the present invention is to provide a new and improved portable hut including selectively removable inflatable air mattress portions secured to the floor of the hut organization.

Even still another object of the present invention is to provide a new and improved portable hut including luminescent panels positioned on a forward portion of the tent entranceway to orient users thereof during periods of limited light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of the instant invention in a partially erected configuration.

FIG. 7 is an isometric illustration of the instant invention when erected.

DESCRIPTION OF THE PREFERRED EMBODIMENT

Figure 1:
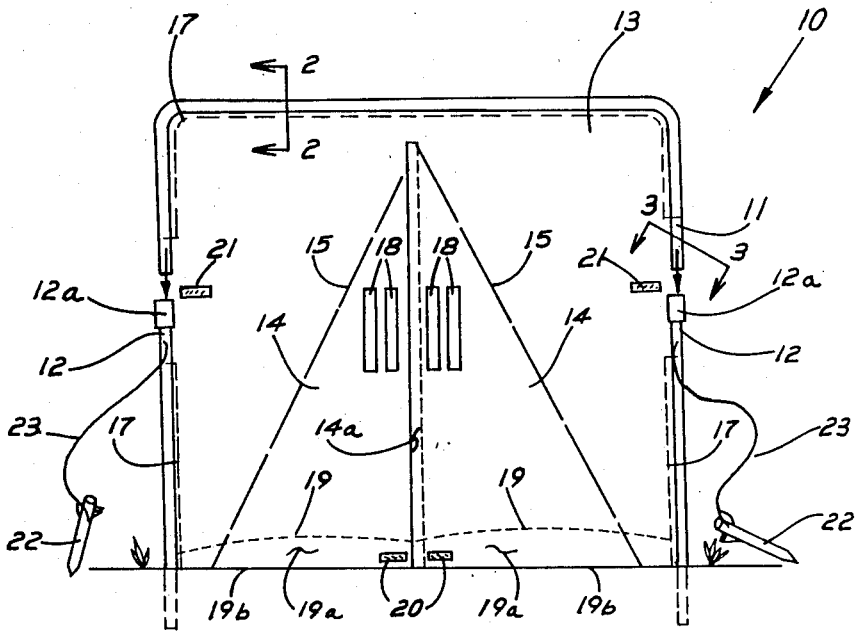
FIG. 1 is an orthographic view taken in elevation of the instant invention.

With reference now to the drawings, and in particular to FIG. 1 thereof, a new and improved portable hut embodying the principles and concepts of the present invention and generally designated by the reference numeral 10 will be described.

More specifically, it will be noted that the portable hut apparatus 10 essentially comprises forward and rear "U" shaped top supports 11 interfitting and engageable with corner elongate supports 12 within the elongate supports' enlarged coupling 12*a*. Tent fabric of conventional material is utilized, such as nylon, treated fabric, etc., in the formation of the main tent body portion 13. Forward front entrance flaps 14 are pivotally secured to tent body 13 by means of seams 15. Velcro (T.M.) is utilized at portions 20 and 21 for temporary securement of the front entrance flaps 14 to an open position where conventional Velcro hook and loop organizations are utilized to effect the means of holding the tent flaps open. Additionally, Velcro or a traditional zipper may be utilized in the overlap area 14*a* to selectively secure the flaps together in a closed position.

Figure 2:
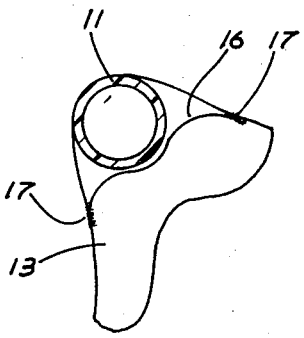
FIG. 2 is an orthographic view taken along the lines 2—2 in FIG. 1 in the direction indicated by the arrows.
Figure 3:
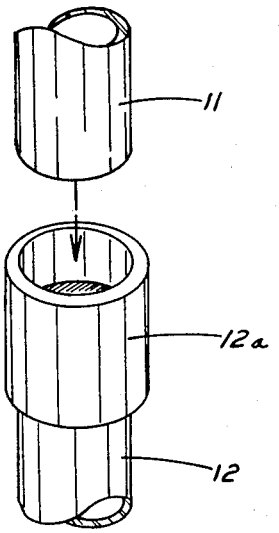
FIG. 3 is an isometric illustration of the invention taken along the lines 3—3 of FIG. 1 in the direction indicated by the arrows.

Attention to FIG. 2 will illustrate the top "U" shaped support 11 captured by means of a capture fabric 16 that is heat seamed, sewn, or adhesively secured to tent fabric 13. The seam 17 "captures" and secures both the "U" shaped supports 11 and the elongate supports 12, as illustrated in FIG. 1. The seam 17 and associated capture fabric 16 are discontinuous proximate the juncture of supports 11 and 12 to enhance visual access and enable manual manipulation of the two support means together. Additionally, luminescent panels 18 are positioned on the tent entrance flaps 14. The luminescent panels 18 enable orientation of a user to the location of the tent and the forward orientation of the tent during dimly lit conditions, such as in cloudy evenings, to enable an individual to more readily locate the tent and its forward opening flaps 14.

The floor of the tent employs a securable zippered floor 19 secured to the remainder of the hut organization by a perimeter zipper 25 illustrated in FIG. 7 to enable the inflatable floor to be removably secured to the tent. By means of conventional inflation valve 26 either side of the tent may be inflated to aid in comfort of a user of the instant invention and in instances where the floor is not desired, such as in ice fishing, the zippered connection 25 is disconnected and the floor 19 and associated air chambers 19*a* are removed. As illustrated in FIG. 1, air chamber 19*a* is enveloped by the floor 19 and its associate surface 19*b* forming the noted air chamber. Understandably, the two respectively formed air chambers may also be selectively secured together to enable removal of only one air chamber if desired.

Figure 4:
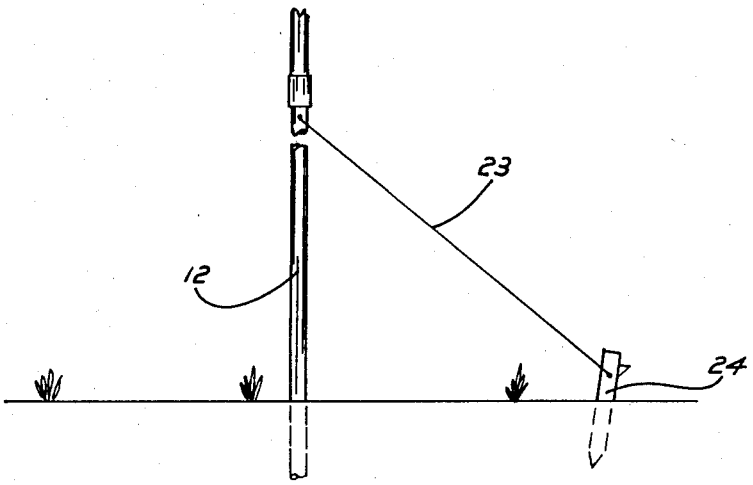
FIG. 4 is an orthographic side view of the securement detail of the instant invention.

As illustrated in FIG. 4, attachment lines 23 are secured to the four corner supports 12 at one end and to a securement pin 22 at the other end for positioning within the ground to impart tension to line 23 and maintain the integrity of the tent once erected. Also for convenience, in FIG. 7 is illustrated the use of carrying handles 24. When the tent is in an interfolded orientation, the carrying handles 24 may be utilized for ease of portability of the organization.

Figure 5:
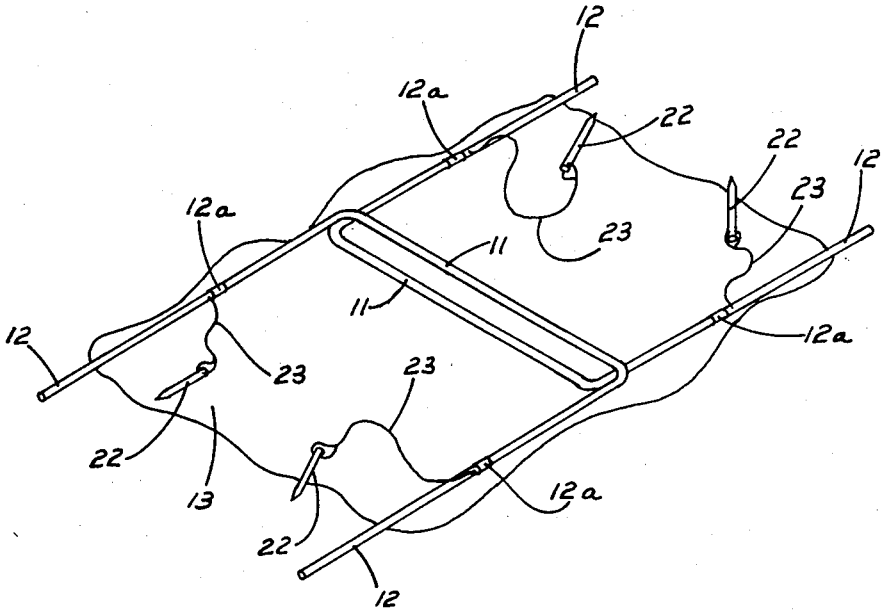
FIG. 5 is an isometric view of the instant invention in a collapsed configuration.
Figure 5:
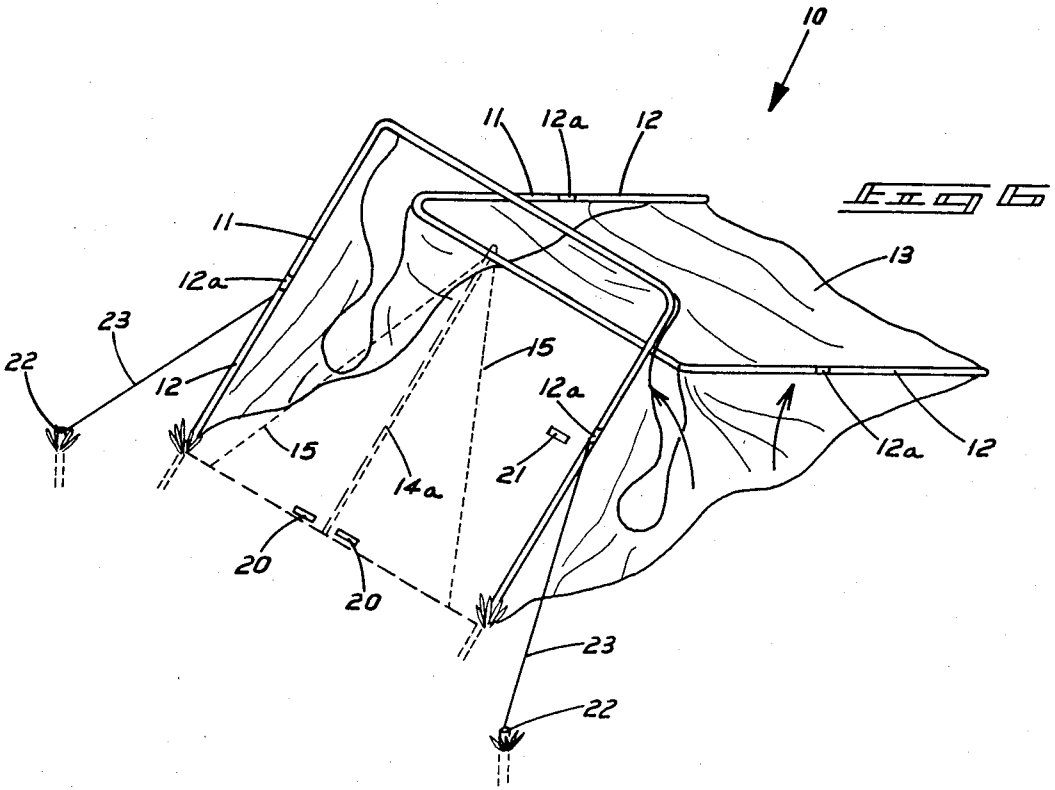
Figure 11:
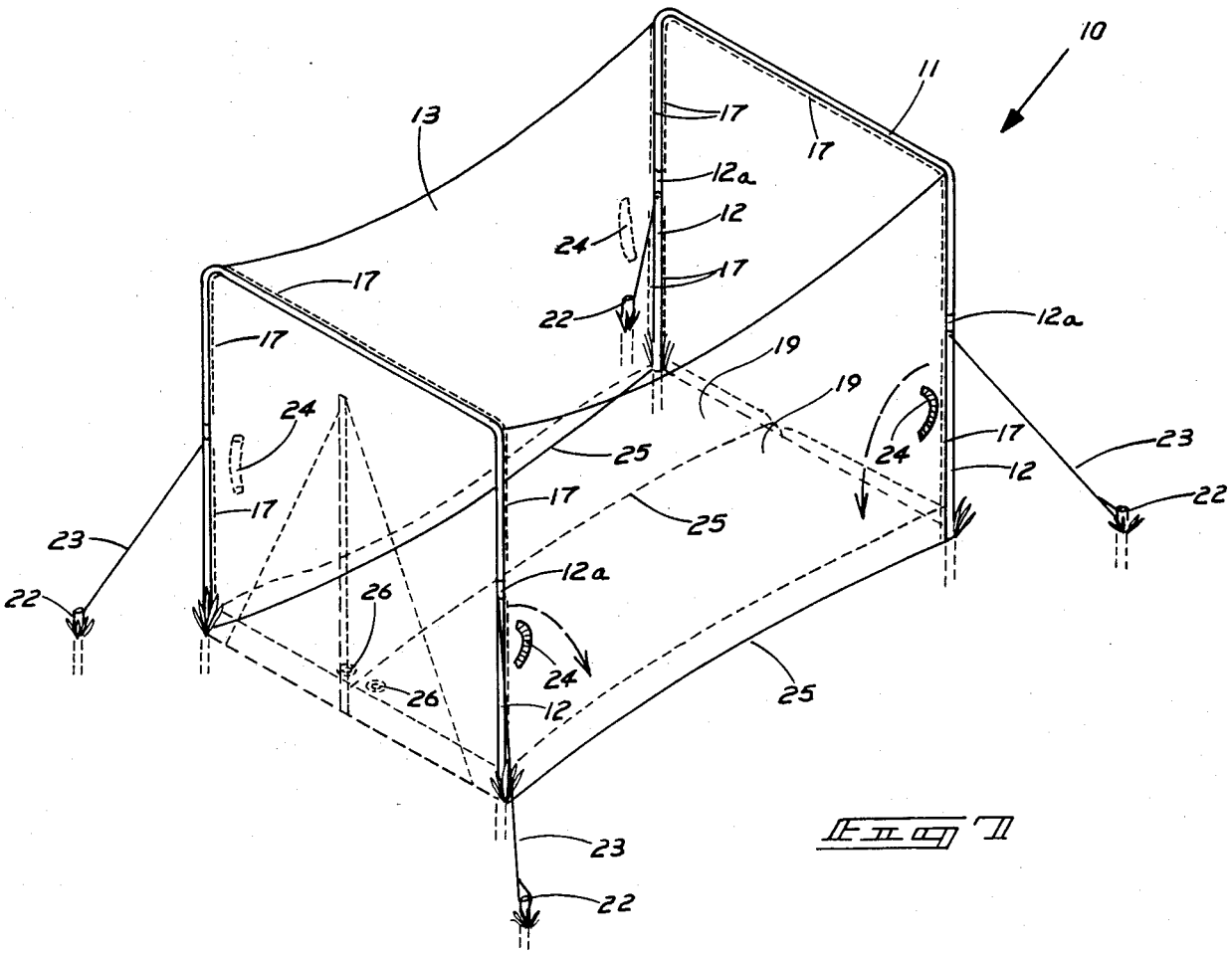

Reference to FIGS. 5, 6 and 7 illustratively represent the direction of the tent erection by indication of the arrows, as in FIG. 6, whereas the tent may be just as readily compacted by reversing the arrows as in FIG. 7.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable tent formed of a fabric including a roof, two vertical side walls and vertical end walls, said tent comprising, a plurality of "U" shaped supports for supporting an uppermost portion of said tent structure, and said "U" shaped supports secured to said tent at the intersection of said roof and said side and end walls, and said "U" shaped supports formed for interfitting engagement with four corner elongate supports, said elongate supports secured at the intersection of said side and end walls, and a separate attachment means secured to each of said elongate supports to impart tension to said elongate supports including attachment to securement pins to impart tension to said attachment means when said secured means are driven into an earthen base, and selectively removable floor means removably attached to said walls, and wherein at least one end wall includes an entrance means wherein said entrance means is formed of a plurality of flaps pivotally secured to said tent, and said flaps temporarily securable into an open position by means of Velcro means, and wherein said flaps include luminescent panels to enable visual location orientation of said tent during dimly lit conditions, and wherein said "U" shaped supports and said elongate supports are secured to said tent by a separate capture fabric secured to said tent fabric wherein said capture fabric forms a conduit for positioning of said "U" shaped supports and said elongate supports therein, and wherein said capture fabric is seamed to said tent fabric to form a triangular conduit securing said supports therein, and said capture fabric is formed co-extensive along the intersection of the side walls and end walls proximate the connection portions of said intersection of said side walls and said end wall proximate the interfitting engagement of the "U" shaped supports and elongate supports, and wherein said removable floor means includes a plurality of selectively inflatable chambers formed therein, and wherein said "U" shaped supports and said elongate supports are associatable by means of said "U" shaped support interfitting with an enlarged coupling cylinder integrally secured to said elongate support, and wherein said tent further includes a plurality of handles secured to said tent walls for enabling manual grasping of said handles effecting portability of said tent when in a collapsed condition.

* * * * *